US006890270B2

(12) United States Patent
Ciasullo

(10) Patent No.: US 6,890,270 B2
(45) **Date of Patent: *May 10, 2005**

(54) GOLF CLUB HEAD

(76) Inventor: Mark Ciasullo, 1 Woodmont Rd., Pine Brook, NJ (US) 07058

( * ) Notice: Subject to any disclaimer, the term of this patent is extended or adjusted under 35 U.S.C. 154(b) by 5 days.

This patent is subject to a terminal disclaimer.

(21) Appl. No.: 10/766,042

(22) Filed: Jan. 29, 2004

(65) Prior Publication Data

US 2004/0185961 A1 Sep. 23, 2004

Related U.S. Application Data

(60) Continuation of application No. 10/207,871, filed on Jul. 31, 2002, now abandoned, which is a division of application No. 09/450,594, filed on Nov. 30, 1999, now Pat. No. 6,739,984.

(51) Int. Cl.[7] ..... A63B 53/04
(52) U.S. Cl. ..... 473/345; 473/349
(58) Field of Search ..... 473/324–350, 473/290–291

(56) References Cited

U.S. PATENT DOCUMENTS

| | | | | |
|---|---|---|---|---|
| 1,946,208 A | | 2/1934 | Hampton | |
| 3,951,326 A | | 4/1976 | Johansson et al. | |
| 4,021,047 A | | 5/1977 | Mader | |
| 4,061,261 A | | 12/1977 | Fredriksson et al. | |
| 4,391,403 A | | 7/1983 | Persson | |
| 4,432,549 A | | 2/1984 | Zebelean | |
| 4,496,096 A | | 1/1985 | Persson | |
| 4,762,322 A | | 8/1988 | Molitor et al. | |
| 4,925,084 A | | 5/1990 | Persson | |
| 5,056,705 A | | 10/1991 | Wakita et al. | |
| 5,232,224 A | | 8/1993 | Zeider | |
| 5,255,913 A | | 10/1993 | Tsuchida | |
| 5,272,802 A | * | 12/1993 | Stites, III | 29/527.2 |
| 5,310,186 A | * | 5/1994 | Karsten | 473/345 |
| 5,328,176 A | | 7/1994 | Lo | |
| 5,346,217 A | | 9/1994 | Tsuchiya et al. | |
| 5,423,535 A | | 6/1995 | Shaw et al. | |
| 5,429,357 A | | 7/1995 | Kobayashi | |
| 5,464,216 A | | 11/1995 | Hoshi et al. | |
| 5,485,998 A | | 1/1996 | Kobayashi | |
| 5,501,459 A | | 3/1996 | Endo | |
| 5,518,240 A | | 5/1996 | Igarashi | |
| 5,531,444 A | | 7/1996 | Buettner | |
| 5,533,729 A | | 7/1996 | Leu | |
| 5,547,427 A | | 8/1996 | Rigal et al. | |
| 5,556,097 A | | 9/1996 | Endo et al. | |
| 5,570,886 A | | 11/1996 | Rigal et al. | |
| 5,620,652 A | | 4/1997 | Tack et al. | |
| 5,624,331 A | | 4/1997 | Lo et al. | |
| 5,637,045 A | | 6/1997 | Igarashi | |

(Continued)

FOREIGN PATENT DOCUMENTS

| | | |
|---|---|---|
| JP | 10099473 | 4/1998 |
| JP | 10151231 | 6/1998 |

*Primary Examiner*—Sebastiano Passaniti
(74) *Attorney, Agent, or Firm*—Arnold D. Litt, Esq.

(57) ABSTRACT

A golf club head includes a sole plate member composed of a first material structure having a first density. The golf club head also includes a top plate member composed of a second material structure distinct from the first material structure, the material structure of the top plate member having an overall density less than the first material structure of the sole plate member, wherein the top plate member includes at least one high density component having a density greater than the overall density of the top plate member. The high density component is positioned rearwardly along the top plate member. The golf club head also includes a face plate member composed of a material structure distinct from the first material structure, the material structure of the face plate member having a density less than the first material structure of the sole plate member. The sole plate member, the top plate member and the face plate member are secured together to form a golf club head offering improved distance.

13 Claims, 1 Drawing Sheet

U.S. PATENT DOCUMENTS 5,658,207 A 8/1997 Aizawa et al.
5,669,825 A 9/1997 Shira
5,669,827 A 9/1997 Nagamoto
5,720,674 A 2/1998 Galy
5,755,624 A 5/1998 Helmstetter
5,755,627 A 5/1998 Yamazaki et al.
5,766,091 A 6/1998 Humphrey et al.
5,839,975 A 11/1998 Lundberg
5,871,408 A 2/1999 Chen
5,888,148 A 3/1999 Allen
5,916,042 A 6/1999 Reimers
5,921,872 A 7/1999 Kobayashi
5,967,904 A 10/1999 Nagai et al.
6,010,411 A 1/2000 Reyes
6,099,414 A 8/2000 Kusano et al.
6,123,627 A 9/2000 Antonious
6,162,130 A 12/2000 Masumoto et al.
6,315,678 B1 11/2001 Teramoto
6,354,962 B1 3/2002 Galloway et al.
6,739,984 B1 * 5/2004 Ciasullo ..... 473/345

* cited by examiner

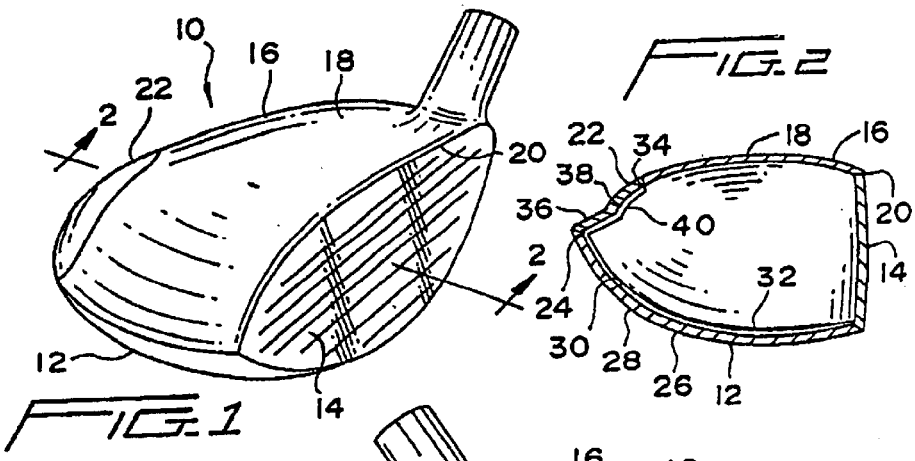
FIG. 1
FIG. 2
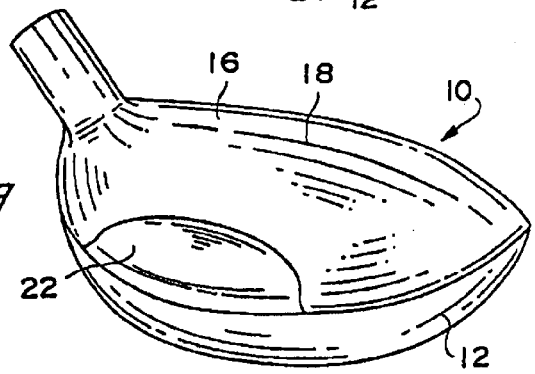
FIG. 3
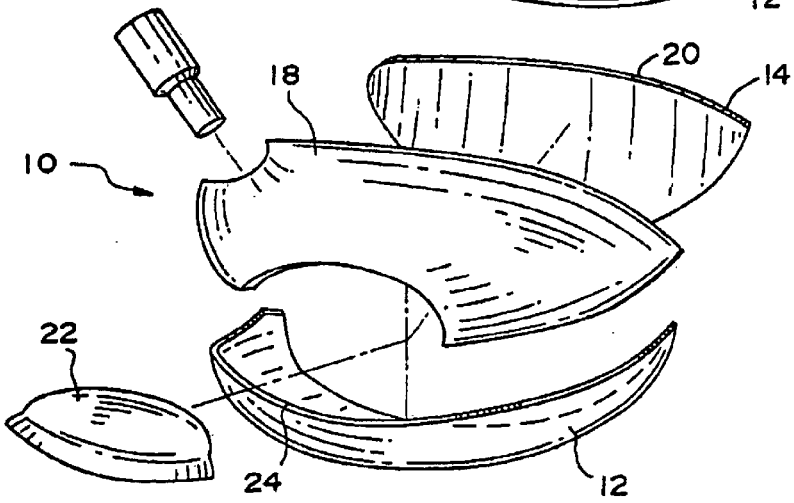
FIG. 4

GOLF CLUB HEAD

RELATED APPLICATIONS

The present application is a continuation of U.S. patent application Ser. No. 10/207,871, filed Jul. 31, 2002, and entitled "GOLF CLUB HEAD", which is now abandoned, which is a divisional of U.S. patent application Ser. No. 09/450,594, filed Nov. 30, 1999, and entitled "GOLF CLUB HEAD", which is now U.S. Pat. No. 6,739,984. The description and drawings of these applications are incorporated herein by reference.

BACKGROUND OF THE INVENTION

1. Field of the Invention

The invention relates to a golf club head. More particularly, the invention relates to a golf club head with a multi-component construction improving both the distance and accuracy offered by the golf club head. The invention further relates to a process for manufacturing multi-component golf club heads.

2. Description of the Prior Art

Over the past ten years, the golf industry has seen an explosion in the development of golf equipment. With regard specifically to golf clubs, a vast number of clubs have been designed to improve accuracy while also increasing distance.

Designers have adopted a variety of techniques and applied new technologies to improve a golf club's striking characteristics. The most profound advance has likely been the complete acceptance of metal woods throughout the golf industry. Properly designed metal woods add distance to a golfer's shots, while also improving his or her accuracy. In fact, the advantages offered by metal woods have virtually lead to the complete disappearance of wood-type clubs manufactured from "wood".

The acceptance of metal woods within the golf industry has opened a variety of new avenues for club development. Golf club designers may now apply designs and materials previously unuseable with wood-based golf club heads. For example, metal woods are now made from a variety of materials which purportedly improve the striking characteristics of club heads by making the club heads stiffer, lighter and harder. Materials have also been mixed within a single club head. By using different materials at specific club head locations, designers are able to improve the striking characteristics of a club head. For example, club heads have been manufactured with a distinct head body and a face plate insert.

The improved distance and accuracy offered by metal woods has opened up the game of golf to many individuals who previously might have found the game to be too difficult to even get past an initial lesson or two. In addition, the development of metal woods has allowed many golfers to continue playing even after physical limitations might have prevented them from effectively playing the game.

The continued development of metal woods will likely add to the continuing popularity of golf as a recreational activity, while also helping to improve the game of those golfers for whom golf has become more than a recreational activity. The present invention presents a golf club head, as well as a method for manufacturing golf club heads, which offer to take the development of metal woods, and golf club heads in general, to a new level.

SUMMARY OF THE INVENTION

It is, therefore, an object of the present invention to provide a golf club head including a sole plate member having a first material construction and a top plate member having a material construction distinct from the first material construction. The material construction of the top plate member has a density less than the first material construction of the sole plate member. The golf club head also includes a face plate member having a material construction distinct from the first material construction, wherein the material construction of the face plate member has a density less than the first material construction of the sole plate member. The sole plate member, the top plate member and the face plate member are bound together to form a golf club head offering improved distance.

It is also an object of the present of the invention to provide a golf club head including a sole plate, a face plate and a top plate. The golf club head comprises a first member positioned rearwardly of the face plate. The first member includes an outer surface and an inner surface, wherein the outer surface is composed of a first material and the inner surface is composed of second material which is coated on the first material of the outer surface. The first material exhibits a greater density than the second material. The club head further includes a second member formed from a material with a density less than the first material of the first member. The first member and the second member are bound together to form a golf club head with a low and rearwardly positioned center of gravity to offer improved distance.

It is a further object of the present of the invention to provide a method for manufacturing a multi-component golf club head including a sole plate, a face plate and a top plate. The method is accomplished by fabricating at least two components to be used in the construction of the golf club head, wherein at least one of the components is formed by explosion welding. The two components are then welded and the assembly of the golf club head is completed.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1 is a perspective view of the golf club head in accordance with the present invention.

FIG. 2 is a cross sectional view along the line 2—2 in FIG. 1.

FIG. 3 is a rear perspective view of the golf club head in accordance with the present invention.

FIG. 4 is an exploded view of the present golf club head.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 4, a multi-component golf club head 10 is disclosed. The golf club head 10 is constructed from a variety of components bound together to form a complete golf club head. In accordance with the preferred embodiment of the present invention, the golf club head is a metal wood. However, the techniques employed in the design, development and manufacture of the disclosed metal wood may be readily applied to other club heads, for example, irons, without departing from the spirit of the present invention.

The golf club head 10 is primarily composed of a sole plate member 12, a face plate member 14 and top plate member 16. The top plate member 16 is preferably composed of a forward top plate member 18 bound to the top edge 20 of the face plate member 14 and a rearward top plate member 22 bound to the rear edge 24 of the sole plate member 12.

While specific components are disclosed above for use in accordance with the present invention, those skill in the art will appreciate the goal of the present invention to move the center of gravity of the golf club head 10 downwardly and rearwardly. With this in mind, a variety of component combinations and designs may be used without departing from the spirit of the present invention.

For example, it is contemplated that the rearward top plate member may be removed from the assembly and the top plate member will be formed as a single piece. Similarly, the golf club head maybe formed from forward and rearward members bound along a center line to complete the construction of the golf club head. Regardless of the specific construction, the spirit and scope of the present invention are considered to be bound only by the appended claims.

The sole plate member 12 is composed of an outer shell 26 preferably formed from stainless steel. The outer shell 26 includes an exterior surface 28 and an interior surface 30 to which an inner shell 32 is bound. The inner shell 32 is preferably formed from titanium bound to the interior surface 30 of the outer shell 26. The outer shell 26 is preferably approximately 0.65 mm thick and the inner shell 32 is preferably approximately 1.4 mm thick, although the thicknesses may be varied, somewhat, without departing from the spirit of the present invention.

The titanium inner shell 32 is bound to the stainless steel outer shell 26 using explosion welding in the following manner. Specifically, sheets of stainless steel and titanium are laid upon each other and placed within a vacuum under extreme pressure. An explosive charge is then set off on both sides of the facing sheets and the force exerted by the charge is sufficient to force the facing sheets to bond on an atomic level. In fact, the force generated by the charge pushes the normally repelling protons and electrons of the sheets aside, thereby allowing the sheets to become bonded, or welded together.

The preferred materials of stainless steel and titanium are disclosed above, although other materials may be readily used without departing from the spirit of the present invention. In fact, titanium is required by the welding technique utilized in the construction of a golf club head in accordance with the present invention. Specifically, the titanium inner shell 32 allows the sole plate member 12 to be welded to the forward top plate member 18 and face plate member 14 formed from titanium.

It is, therefore, contemplated that the sole plate member 12 maybe constructed from a variety of materials so long as the sole plate member 12 offers a greater density than the adjacent forward top plate member 18 and the face plate member 14. With this in mind, and in accordance with the preferred embodiment of the present invention, the sole plate member 12 should be constructed such that the outer shell 26 is composed of a first material and the inner shell 32 is composed of second material, wherein the first material exhibits a greater density than the second material.

The rearward top plate member 22 is similarly constructed with an outer shell 34 preferably formed from stainless steel. The outer shell 34 includes an exterior surface 36 and an interior surface 38 to which an inner shell 40 is bound. The inner shell 40 is preferably formed from titanium bound to the interior surface 38 of the outer shell 34. The titanium inner shell 40 is bound to the outer shell 34 in the same manner described above with regard to the sole plate member 12. The outer shell 34 is preferably approximately 0.65 mm thick and the inner shell 40 is preferably 1.4 mm thick.

As with the sole plate member 12, stainless steel and titanium are the preferred materials, although other materials may be readily used without departing from the spirit of the present. In fact, the use of titanium is required by the welding technique utilized in the construction of a golf club head in accordance with the present invention. Specifically, the titanium inner shell 40 allows the rearward top plate member 22 to be welded to the forward top plate member 18 formed from titanium.

As with the sole plate member 12, it is contemplated that the rearward top plate member 22 may be constructed from a variety of materials so long as the rearward top plate member 22 offers a greater density than the adjacent forward top plate member 18 and the face plate member 14. With this in mind, and in accordance with the preferred embodiment of the present invention, the rearward top plate member 22 should be constructed such that the outer shell 34 is composed of a first material and the inner shell 40 is composed of second material, wherein the first material exhibits a greater density than the second material.

The forward top plate member 18 and the face plate member 14 are preferably fabricated from titanium. The forward top plate member 18 and the face plate member 14 are preferably formed with respective thicknesses of approximately 1.3 to 1.4 mm and 3.2 mm, although other thicknesses may be employed without departing from the spirit of the present invention. Generally, and in accordance with the objectives of the present golf club head 10, the forward top plate member 18 and the face plate member 4 are formed from a material with a density less than the outer shell material of the sole plate member 12.

By defining the material composition of the sole plate member 12, the rearward top plate member 22, the forward top plate member 18 and the face plate member 14 as discussed above, the present golf club head 10 exhibits previously unknown striking characteristics. Specifically, by incorporating substantial quantities of stainless steel in the sole plate member 12 and the rearward top plate member 22, the center of gravity of the golf club head 10 is moved downwardly and rearwardly to improve the striking characteristics of the golf club head 10.

The lower center of gravity provided by club heads manufactured in accordance with the present invention produces an improved launch angle which ultimately increases the carry distance of golf balls struck in a similar manner. It is further believed that the rigidity of the stainless steel forming the sole plate member 12 improves the flex characteristics of the face plate member 14. Specifically, where a golf club head is formed entirely from titanium, flexing of the face plate member upon impact is spread throughout the golf club head to thereby reduce the momentum imparted to a struck golf ball. The stainless steel framework offered by the present sole plate member 12, optimizes the flexing in the face plate member 14 to impart more momentum to a struck golf ball.

The ability of the present invention to incorporate stainless steel and titanium in the construction of the one-piece club head body is achieved by the application of explosion welding in the fabrication of the present golf club head. Specifically, titanium and stainless steel are very difficult to securely weld in a manner required for the construction of the body for a golf club head. However, the use of explosion welding in the fabrication of the present golf club head allows for the construction of a golf club head taking advantage of the attributes offered by both stainless steel and titanium.

Golf club heads in accordance with the present invention are manufactured in the following manner. After the stainless steel/titanium sheets are bound via explosion welding in the manner discussed above, the desired pieces (i.e., the sole plate member 12 and the rearward top plate member 22) are cut from the previously formed stainless steel/titanium sheet. The remaining parts are simply cut from standard titanium sheets of an appropriate thickness. All of the parts are then forged under controlled heat to their desired shapes (see FIG. 4). The various components are then spot welded using an argon gas torch. Spot welding is used to hold the components in their desired positions. At this point, the spot welded club head is placed in an argon gas chamber and final welding is completed. The club head is then ground, polished and painted in preparation for use.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A golf club head, comprising:

a sole plate member being composed of a first material structure having a first density;

a top plate member being composed of a second material structure distinct from the first material structure, the material structure of the top plate member having an overall density less than the first material structure of the sole plate member, wherein the top plate member includes at least one high density component having a density greater than the overall density of the top plate member, the high density component being positioned rearwardly along the top plate member;

a face plate member being composed of a material structure distinct from the first material structure, the material structure of the face plate member having a density less than the first material structure of the sole plate member; and wherein the sole plate member, the top plate member and the face plate member are secured together to form a golf club head offering improved distance.

2. The golf club head according to claim 1, wherein the sole plate member includes an outer surface and an inner surface, and the outer surface is composed of a first material and the inner surface is composed of a second material which is welded to the first material of the outer surface, the first material exhibiting a greater density than the second material.

3. The golf club head according to claim 2, wherein wherein the first material is stainless steel and the second material is titanium.

4. The golf club head according to claim 2, wherein the sole plate member is formed by explosion welding.

5. The golf club head according to claim 2, wherein the high density component of the top plate member includes an outer surface and an inner surface, and the outer surface is composed of a first material and the inner surface is composed of a second material which is welded to the first material of the outer surface, the first material exhibiting a greater density than the second material.

6. The golf club head according to claim 5, wherein the first material is stainless steel and the second material is titanium.

7. The golf club head according to claim 6, wherein the high density component is formed by explosion welding.

8. The golf club head according to claim 1, wherein the high density component of the top plate member includes an outer surface and an inner surface, and the outer surface is composed of a first material and the inner surface is composed of a second material which is welded to the first material of the outer surface, the first material exhibiting a greater density than the second material.

9. The golf club head according to claim 8, wherein wherein the first material is stainless steel and the second material is titanium.

10. The golf club head according to claim 8, wherein the high density component is formed by explosion welding.

11. The golf club head according to claim 1, wherein the top plate member includes at least one component formed from a second material which is less dense than a first material, and the top plate member includes a forward top plate member formed from the second material and a rearward top plate member composed of the high density member; the rearward top plate member includes an outer surface and an inner surface, and the outer surface is composed of the first material and the inner surface is composed of the second material which is welded to the first material of the outer surface.

12. The golf club head according to claim 11, wherein the first material is stainless steel and the second material is titanium.

13. The golf club head according to claim 11, wherein the rearward top plate member is formed by explosion welding.

* * * * *